US006705746B2

(12) United States Patent
Perlo et al.

(10) Patent No.: US 6,705,746 B2
(45) Date of Patent: Mar. 16, 2004

(54) CONTROLLED-LUMINANCE LIGHTING DEVICE

(75) Inventors: Piero Perlo, Sommariva Bosco (IT); Denis Bollea, Fiano (IT); Davide Capello, Turin (IT); Piermario Repetto, Turin (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/145,886

(22) Filed: May 16, 2002

(65) Prior Publication Data

US 2002/0172044 A1 Nov. 21, 2002

(30) Foreign Application Priority Data

May 18, 2001 (IT) ..... TO01A0460

(51) Int. Cl.[7] ..... F21V 7/00; F21V 13/02

(52) U.S. Cl. ..... 362/290; 362/291; 362/297; 362/342; 362/325; 362/354; 362/343; 362/292

(58) Field of Search ..... 362/290–292, 362/296, 297, 341, 342, 325, 354

(56) References Cited

U.S. PATENT DOCUMENTS

| | | | | |
|---|---|---|---|---|
| 4,729,075 A | | 3/1988 | Brass | 362/217 |
| 4,751,626 A | | 6/1988 | Plewman | 362/346 |
| 5,613,762 A | | 3/1997 | Agabekov | 362/240 |
| 6,231,212 B1 | * | 5/2001 | Cooney et al. | 362/290 |

FOREIGN PATENT DOCUMENTS

| | | | |
|---|---|---|---|
| JP | 04133205 A | 5/1992 | F21V/17/00 |

* cited by examiner

*Primary Examiner*—Sandra O'Shea
*Assistant Examiner*—Sharon Payne
(74) *Attorney, Agent, or Firm*—Sughrue Mion, PLLC

(57) ABSTRACT

A controlled-luminance lighting device comprising a fluorescent light source of a linear type (5), which extends longitudinally between a reflector (1) that is formed by an elongated body having a curved surface, and a set of transverse fins (3), which are set at a distance apart from one another and which define a grill for directional control of the light emitted by the light source (5). The reflector (1) defines, together with the transverse fins (3), a plurality of elements (2) set alongside one another of a generally parabolic shape.

6 Claims, 3 Drawing Sheets

CONTROLLED-LUMINANCE LIGHTING DEVICE

FIELD OF THE INVENTION

The present invention relates to lighting devices, for example ones used in residential, commercial and industrial environments, of the kind comprising at least one fluorescent light source of a linear type, which extends longitudinally between a reflector that is formed by an elongated body having a curved surface, and a set of transverse fins, which are set at a distance apart from one another and which define a grill for directional control of the light emitted by the light source.

Light sources of the above sort consist, in practice, of a reflecting optical system designed to control the direction of the outcoming light, guaranteeing limits of luminance below dazzling.

With lighting devices of this kind, control of luminance proves problematical in the case of particularly extensive fluorescent light sources. In fact, with the embodiments currently produced and marketed, in which the transverse fins are generally made up of simple extruded metallic elements having a parabolic profile in the direction perpendicular to the direction of extrusion, angular control of the outcoming light is effective only in the planes that are, respectively, perpendicular and parallel to the axis of the lamp. In the remaining directions, this control is normally ineffective, and, in any case, insufficient.

SUMMARY OF THE INVENTION

The purpose of the present invention is precisely to solve the above problem and to provide a lighting device of the type defined above, which is designed to enable control of the luminance in all directions.

According to the invention, the above purpose is achieved basically thanks to the fact that, in a lighting device of the type defined at the beginning of this description, the reflector defines, together with said transverse fins, a plurality of elements set alongside one another having a generally parabolic shape. The curved surface of the elongated body 1 is curved in a longitudinal direction of the elongated body and transversely with respect to each transverse fin 3.

Each of said elements set alongside one another conveniently has a bottom wall formed with a cusp in a position corresponding to the light source.

According to a preferred embodiment of the invention, the reflector is made up of two separable units, one of which includes said fins and the other includes the bottom walls of said elements set alongside one another. Each transverse fin 3 is provided with e double curvature both with respect to a longitudinal plane and a transverse plane perpendicular to the light source 5 as best seen in FIGS. 1 and 4.

BRIEF DESCRIPTION OF THE DRAWINGS

The present invention will now be described in detail with reference to the attached drawings, which are provided purely by way of non-limiting example, and in which.

DETAILED DESCRIPTION OF THE INVENTION

Figure 1:
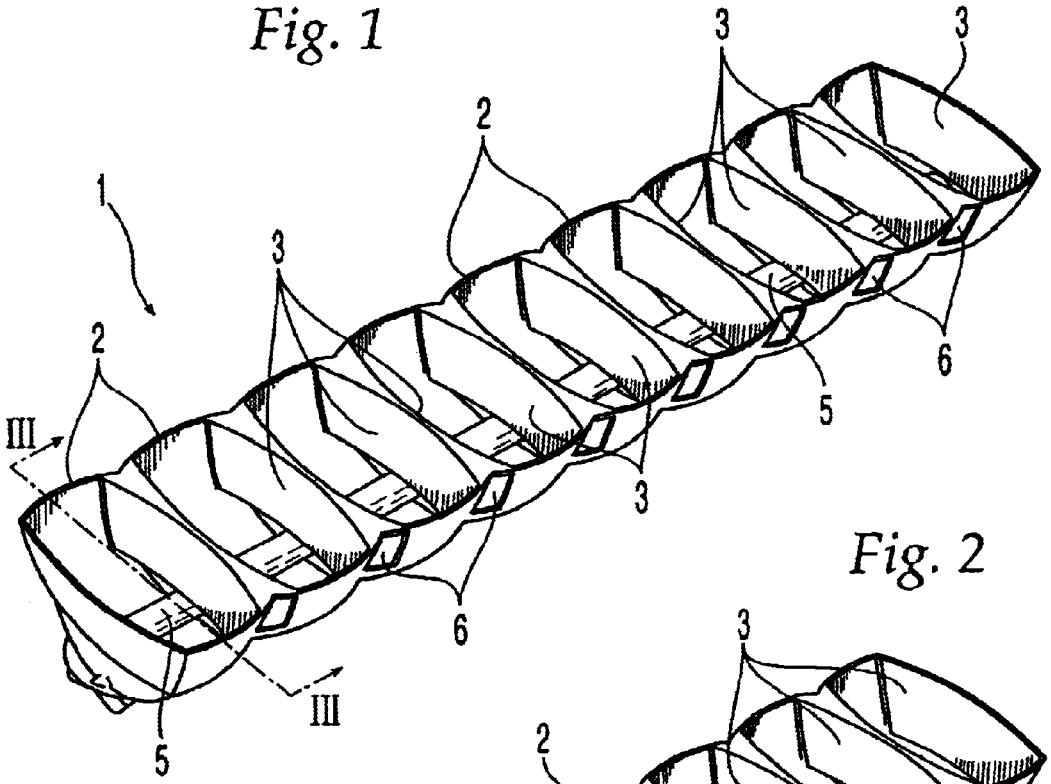
FIG. 1 is a schematic perspective plan view from underneath of a controlled-luminance lighting device according to the invention.
Figure 2:
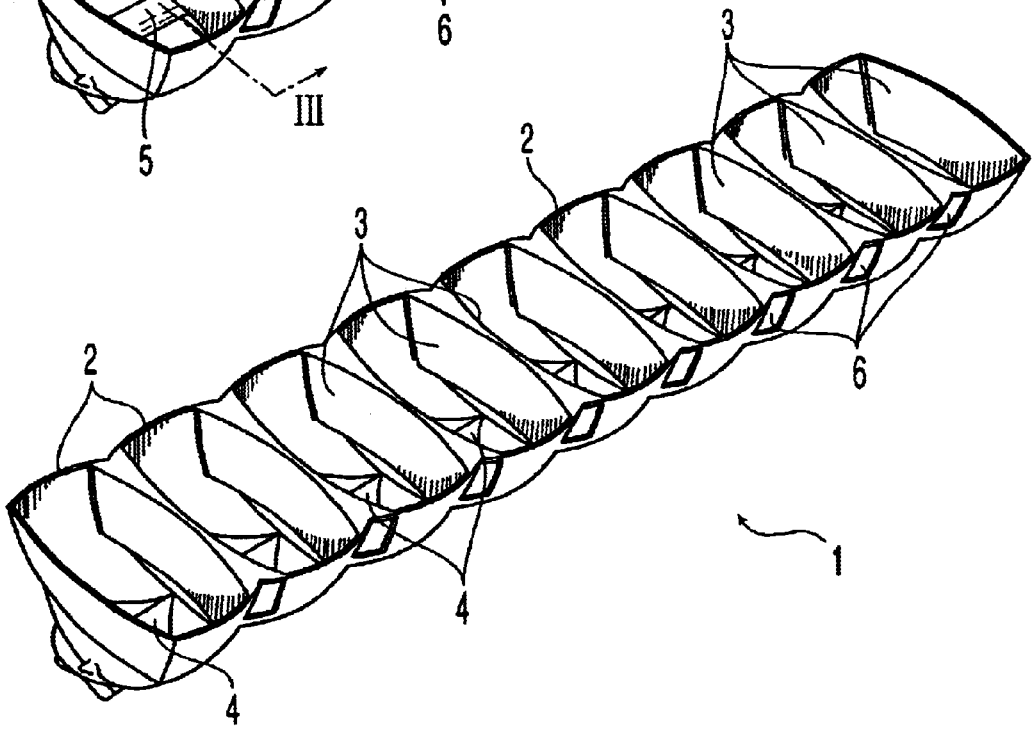
FIG. 2 is a view similar to that of FIG. 1, in which, however, the light source has been suppressed in order to highlight the structure of the device better.

The lighting device illustrated by way of example in the drawings is made up of a reflecting-optical system designed to control the outcoming light beam angularly in its longitudinal plane and in its transverse plane, as well as in all the intermediate planes comprised between the above planes, so guaranteeing limits of luminance below dazzling.

With reference to the drawings, the lighting device according to the invention comprises a reflector, designated as a whole by 1, formed by an elongated body having its internal surface generally curved. Said elongated body 1 is, in effect, defined by a set of tray-like elements 2 having a parabolic shape, which are separated from one another by transverse fins 3 set apart from each other, the said fins having a shaped profile. The curved surface of the elongated body 1 is curved in a longitudinal direction of the elongated body and transversely with respect to each transverse fin 3.

Figure 3:
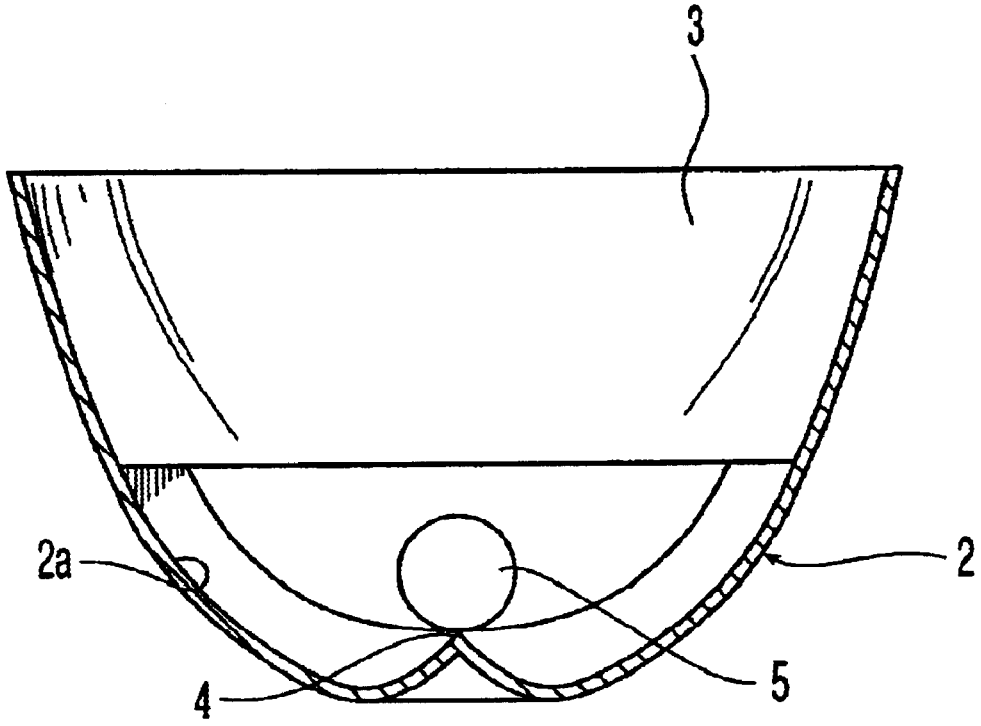
FIG. 3 is a cross-sectional view at an enlarged scale taken along the line III—III of FIG. 1.

As may be seen more clearly in FIG. 3, the bottom wall 2*a* of each element 2 is formed with a cusp 4, above which there extends a fluorescent light source 5 of a linear type, the length of which substantially corresponds to the length of the elongated body 1.

The transverse fins 3, which define a grid for directional control of the light emitted by the source 5, have a three-dimensional profile with curved sides and are conveniently hollow so as to define compartments 6 between each pair of adjacent elements 2. Each transverse fin 3 is provided with a double curvature both with respect to a longitudinal plane and a transverse plane perpendicular to the light source 5 as best seen in FIGS. 1 and 4.

Figure 4:
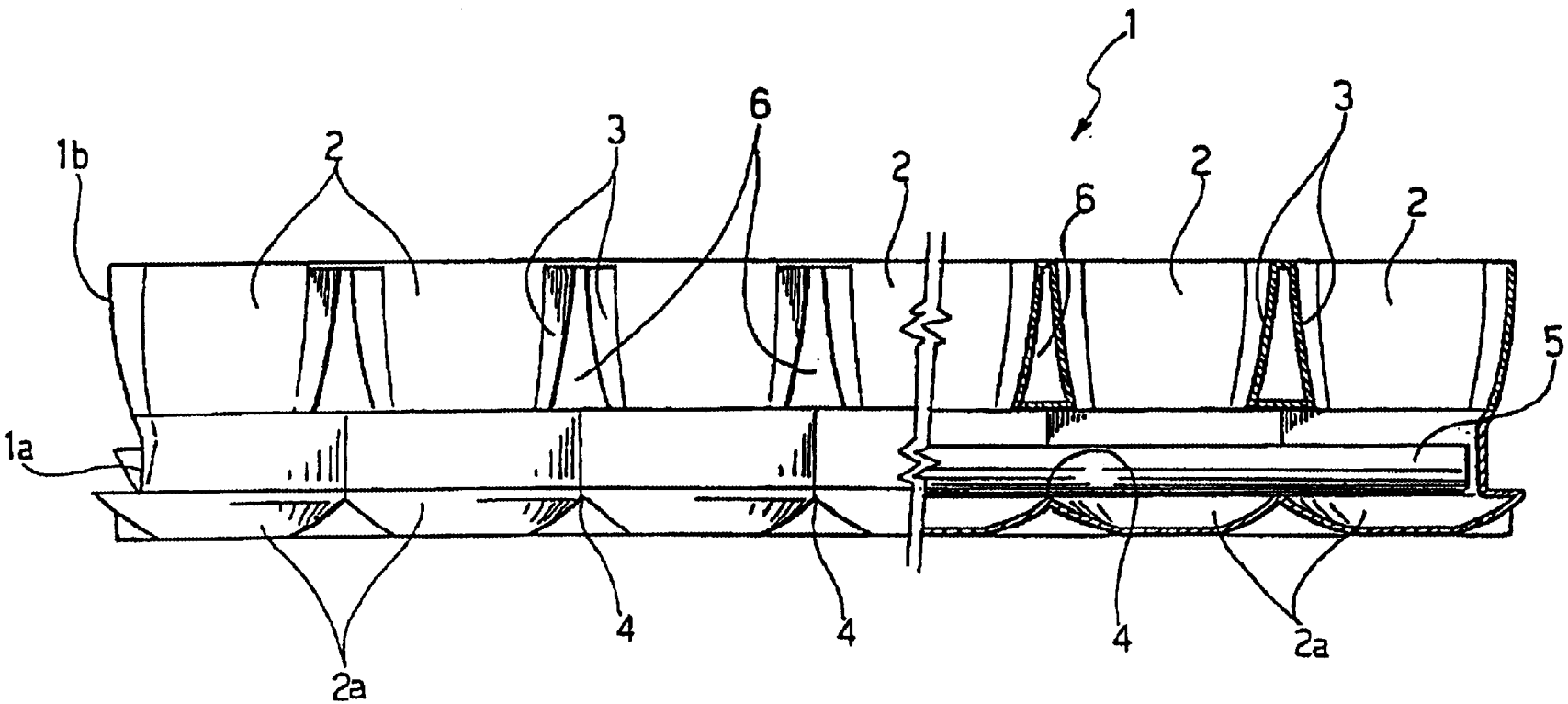
FIG. 4 is a side elevation and partially sectioned longitudinal view of FIG. 1.

As is illustrated greater detail in FIG. 4, the elongated body 1 can advantageously be made up of two longitudinal portions, which can be separated from one another in order to facilitate positioning of the light source 5 and which are then assembled together using any suitable system. The above longitudinal portions include a lower portion 1*a*, forming the lower portions of the elements 2 with the corresponding bottom walls 2*a* and cusps 4, and an upper portion 1*b*, which includes the upper areas of the elements 2 and the transverse fins 3.

With the arrangement described above, the lighting device according to the invention enables angular control of the light beam generated by the source 5, not only in the plane perpendicular to the axis of the source 5 and in the plane parallel to the axis of the source 5, but also in all the planes that are intermediate between the above planes.

The device according to the invention can be set into a wall or ceiling (obviously, in a position upside down with respect to the one illustrated in the drawings) or it can be set suspended. In this case, the device may conveniently be formed with openings or slits in positions corresponding to the bottom walls 2*a* of the elements 2.

It should moreover be pointed out that the device described above is modular, in the sense that it can be made up of similar devices in order to obtain the widest possible range of configurations.

Of course, the details of construction and the embodiments may vary widely with respect to what is described and illustrated herein purely by way of example, without thereby departing from the scope of the present invention, as defined in the ensuing claims.

What is claimed is:

1. A controlled-luminance lighting device, comprising at least one fluorescent light source of a linear type (5), which extends longitudinally between a reflector (1) that is formed by an elongated body having a curved surface, and a set of transverse fins (3), which are set at a distance apart from one another and which define a grill for directional control of the light emitted by said light sources, wherein the curved surface of the elongated body is curved in a longitudinal direction of the elongated body and transversely with respect to each transverse fin to define a set of tray-shaped elements each having a generally parabolic shape, and wherein each fin is provided with a double curvature both with respect to a longitudinal plane and a transverse plane perpendicular to the at least one light source.

2. The device according to claim 1, wherein said fins (3) have a three-dimensional profile.

3. The device according to claim 2, wherein said fins (3) are hollow.

4. The device according claim 1, wherein each of said elements (2) set alongside one another has a bottom wall **(2*a*) formed with a cusp (4), in a position corresponding to the light source (5)**.

5. The device according to claim 4, wherein said reflector (1) is made up of two separable units **(1*a*, 1*b*), one of which includes the bottom walls (2*a*) of said elements (2) set alongside one another, and the other of which includes said transverse fins (3)**.

6. The device according to claim 1, designed to be set in or suspended.

* * * * *